US007469944B2

(12) United States Patent
Kitayama et al.

(10) Patent No.: US 7,469,944 B2
(45) Date of Patent: Dec. 30, 2008

(54) VEHICLE DOOR CHECKER HAVING A WATER MANAGEMENT DAM

(75) Inventors: Kenichi Kitayama, Dublin, OH (US); Robert Bator, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/420,239

(22) Filed: May 25, 2006

(65) Prior Publication Data

US 2007/0241569 A1 Oct. 18, 2007

Related U.S. Application Data

(60) Provisional application No. 60/744,207, filed on Apr. 4, 2006.

(51) Int. Cl.
*E05C 17/04* (2006.01)

(52) U.S. Cl. ..... 292/262; 292/DIG. 15; 292/DIG. 19; 16/86 C; 16/86 A

(58) Field of Classification Search ..... 292/DIG. 19, 292/262, 266, 275, DIG. 15, 265; 16/86 C, 16/86 K See application file for complete search history.

(56) References Cited

U.S. PATENT DOCUMENTS 5,173,991 A 12/1992 Carswell
5,474,344 A * 12/1995 Lee ..... 292/262
5,862,570 A * 1/1999 Lezuch et al. ..... 16/82
7,240,399 B2 * 7/2007 Murayama et al. ..... 16/82
2004/0068833 A1 * 4/2004 Sawa ..... 16/60
2004/0251696 A1 * 12/2004 Murayama et al. ..... 292/262
2005/0236846 A1 * 10/2005 Hidaka et al. ..... 292/216

FOREIGN PATENT DOCUMENTS

JP 572923 A * 5/1993

* cited by examiner

*Primary Examiner*—Patricia Engle
*Assistant Examiner*—Mark Williams
(74) *Attorney, Agent, or Firm*—Rankin, Hill & Clark LLP; Mark E. Duell

(57) ABSTRACT

A vehicle door checker is provided that includes a housing attachable to a vehicle door, an arm having a first portion attachable to the vehicle, and wherein a second portion of the arm moves through the housing when the door is moved. The door checker also includes at least one slider held within the housing that is in sliding contact with the second portion of the arm inside of the housing. At least one biasing member is held within the housing, the biasing member biasing the slider against the second portion of the arm. A water management dam provides a barrier in the housing such that water is prevented from accumulating within the housing and freezing, wherein such freezing would cause damage to the housing and/or prevent the biasing member and slider from moving.

2 Claims, 4 Drawing Sheets

VEHICLE DOOR CHECKER HAVING A WATER MANAGEMENT DAM

This application claims priority to U.S. provisional patent application 60/744,207, filed on Apr. 4, 2006, currently pending, the entire disclosure of which is incorporated by reference herein.

BACKGROUND OF THE INVENTION

Vehicle door checkers are used to hold vehicle doors in one of a number of desired positions, such as three quarters of the way opened and fully opened. Most vehicle door checkers include an arm that is attached at a first end to the frame or body, via a pivotable mount. When the door is fully opened, the second, opposite, end of the arm is inside of a housing that is attached to the vehicle door, while a middle portion of the arm between the first and second ends is located between the housing and the pivotable mount. As the door is closed, the housing slides over the arm, starting from the second end of the arm through the middle portion, toward the first end of the arm.

The arm includes a series of notches along the length of the middle portion that correspond to desired holding positions of the door. As the housing moves over the arm, a slider held within the housing rides along the surface of the arm. The slider is biased against the arm, typically by a helical spring, so that when a notch or peak is encountered, contact is maintained between the slider and arm. An additional amount of force applied to the door is required to move the arm past the slider when either a peak or notch of the arm is encountered. Thus, in such a position, the door is held in place until the extra amount of force is applied.

U.S. Pat. No. 5,862,570 to Lezuch et al. discloses a door checker that further includes a rubber or foam-like cylinder that is used as a dampening member inside the helical type springs of the housing.

In the art, housings are typically mounted on the inside of the vehicle door. In this position, the housing is subject to the intrusion of water. Because vehicles are used outdoors and often stored outdoors, water that enters the housing in liquid form is susceptible to freezing. Expansion during freezing can cause failure of the housing and prevent the components inside the housing from moving. The foam cylinder of the Lezuch et al. patent does not prevent water from accumulating in the housing. What is desired is an effective water dam to prevent accumulation of water in the housing of a typical vehicle door checker.

BRIEF SUMMARY OF THE INVENTION

The present invention overcomes these and other disadvantages in the prior art. The door checker of the present invention includes a water checking dam that prevents the accumulation of water in a checker housing.

In accordance with the present invention, a vehicle door checker is provided that includes a housing attachable to a vehicle door, an arm having a first portion attachable to the vehicle, and a second portion that moves through the housing when the door is moved. The door checker also includes one or more sliders held within the housing that are in sliding contact with the second portion of the arm inside of the housing. One or more biasing members are also held within the housing, each biasing member biasing a slider against the second portion of the arm passing through the housing. A water management dam fills a portion of the housing such that water is prevented from accumulating within the housing. The water management dam is preferably formed from a closed cell foam.

These and other features, aspects and advantages of the present invention will be fully described by the following description, appended claims, and accompanying drawings.

DETAILED DESCRIPTION OF THE INVENTION

Figure 1:
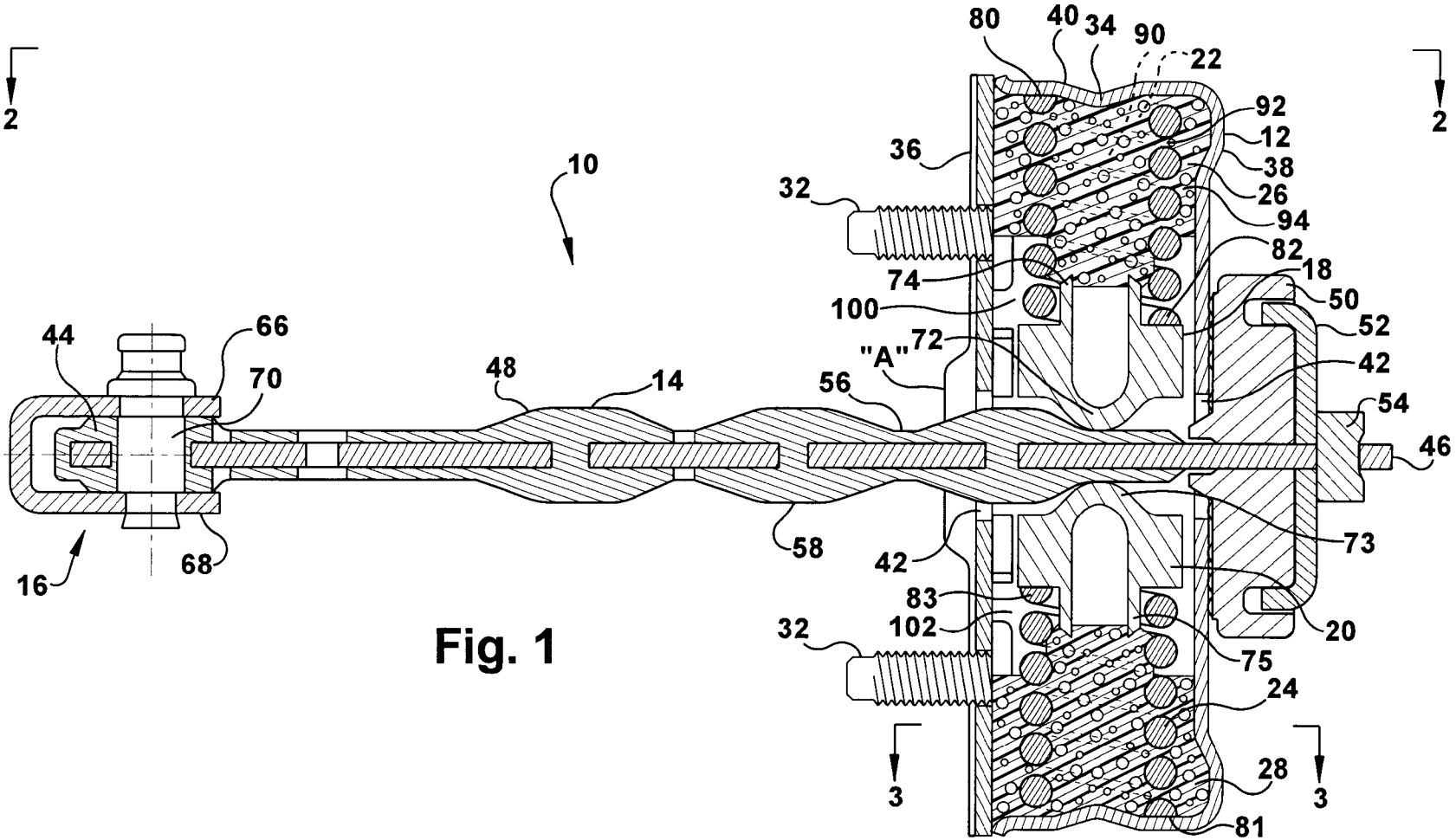
FIG. 1 is a cross-sectional view of a vehicle door checker having a water management dam of the present invention.

Referring to the drawings, specifically FIG. 1, a preferred door checker including a water management dam according to the present invention is illustrated. The door checker 10 includes a housing 12, an arm 14, a pivotable mount 16, two sliders 18 and 20, two biasing members 22 and 24 associated with the sliders 18 and 20, and water management dams 26 and 28 located on opposite sides of the housing 12.

Figure 2:
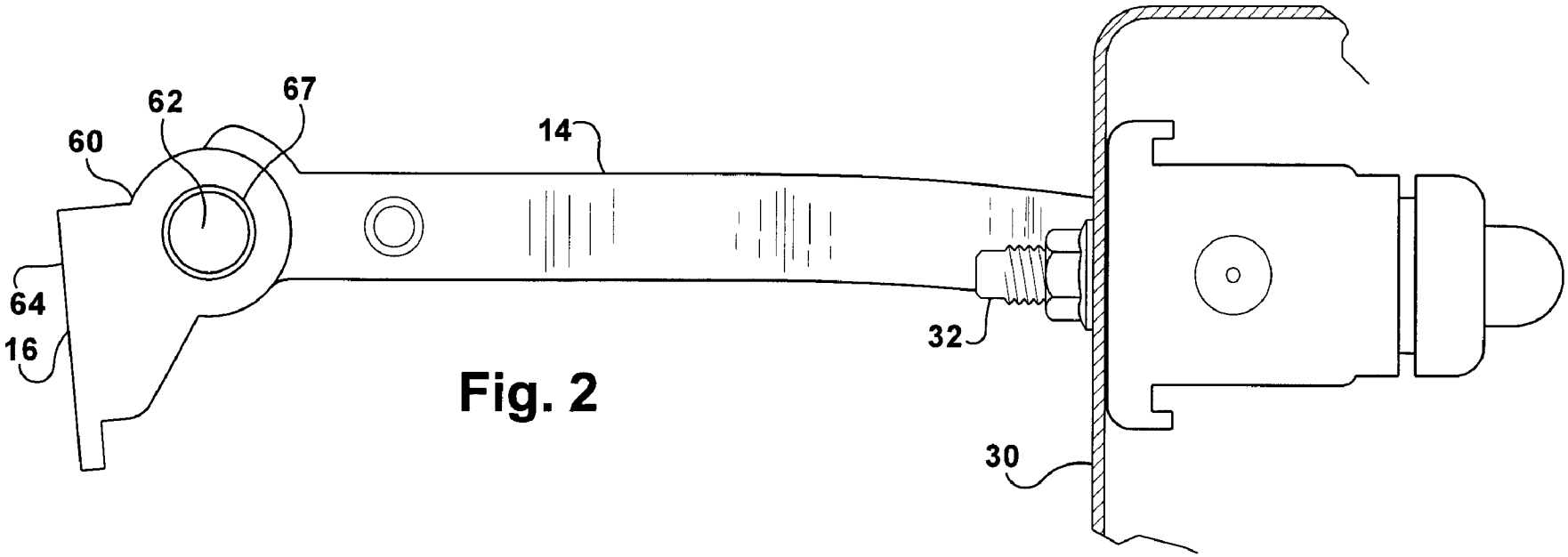
FIG. 2 is a top view of the vehicle door checker.

Referring to FIGS. 1 and 2, the housing 12 is generally cylindrical and is mounted to a vehicle door 30 using bolts 32. Preferably, the housing 12 is formed from a case portion 34 and a cover 36. The case portion 34 includes a base 38 and raised walls 40. The cover 36 is generally flat. The housing 12 is generally hollow and defines two apertures 42 near a mid-section of the housing, one aperture 42 being defined by the cover 36 and the second aperture being defined by the base 38 of the case portion 34. Absent use of the water management dams 26 and 28 of the present invention, water has a tendency to enter the housing 12 either between the junction of the case portion 34 and cover 36, where bolts 32 pass through the cover 36, or through one or both of the apertures 42 and fill the housing 12.

The arm 14 is elongated, having a first end 44 and a second end 46 and a middle section 48 therebetween. A stopper 50, stopper plate 52 and stopper pin 54 are secured to the arm 14 adjacent the second end 46. The stopper 50 is positioned closest to the middle section 48 of the arm 14, the stopper plate 52 is adjacent to the stopper 50 and the stopper pin 54 is adjacent to the stopper plate 52. The middle section 48 includes a series of notches 56 and raised portions 58 of a type well known in the art. Preferably, each notch 56 is flanked by two raised portions 58.

The pivotable mount 16 includes a bracket 60 and a checker pin 62. The bracket 60 preferably includes a back 64, a first leg 66 and a second leg 68 that extend from the back 64 and are parallel to one another. Both the first leg 66 and the second leg 68 define an aperture 67 and the apertures are aligned such that the checking pin 62 may be inserted through the apertures in both the first leg 66 and the second leg 68 in a direction parallel to the back 64 of the bracket 60. The arm 14 defines an aperture 70 near its first end 44 and the checking pin 62 also passes through this aperture 70 which results in the arm 14 being pivotably attached to the bracket 60.

A first slider 18 is held within the housing 12 in a position adjacent to a middle portion 48 of the arm 14 that passes through the housing 12. The first slider 18 is puck shaped, but includes a nipple 72 on one face and a post 74 on an opposite face. The nipple 72 is biased by biasing member 22 into constant contact with the middle portion 48 of the arm 14 that passes through the housing 12. The post 74 provides a locating means for the proper positioning of a biasing member 22 with respect to the slider 18. The first slider 18 slides lengthwise within the housing 12.

A second slider 20 is configured within the housing 12 in a similar manner as the first slider 18 and has the same shape as the first slider 18, but on an opposite side of the arm 14 from the first slider 18. The second slider 20 includes a nipple 73 and a post 75 configured in the same manner as the nipple 72 and post 74 on the first slider 18.

The first biasing member 22 is held within the housing 12 adjacent to the slider 18. The first biasing member 22 is preferably a helical spring. A first end 80 of the first biasing member 22 abuts the raised wall 40 of the case portion 34 of the housing 12 and a second end 82 of the first biasing member 22 abuts the first slider 18. The helical spring defines a cylindrical space inside of the spring coils and into which the post 74 fits. As the first slider 18 moves away from the second slider 20 within the housing 12, because of a peak 58 on the arm 14, the biasing member 22 is compressed. Then, as the first slider 18 moves toward the second slider 20 of the housing 12, after passing the peak 58 in the arm 14, the biasing member 22 is expanded.

A second biasing member 24 is configured within the housing 12 in a similar manner as the first biasing member 22 and having the same shape as the first biasing member 22, but on an opposite side of the arm 14 from the first biasing member 22. The second biasing member 24 includes a first end 81 that abuts the raised wall 40 of the case portion 34 of the housing 12 and a second end 83 that abuts the second slider 20.

Figure 3:
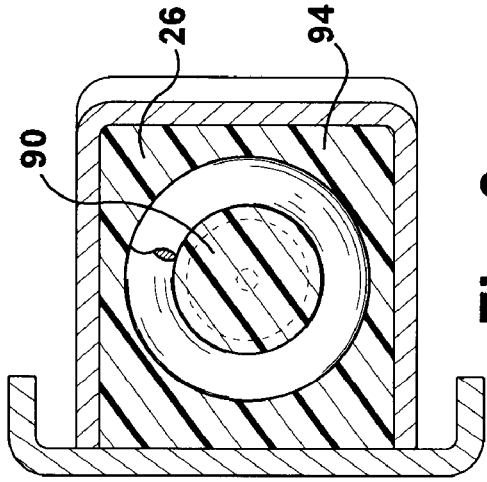
FIG. 3 is an additional cross-sectional view of a portion of the vehicle door checker.

The first water management dam 26 is a filler that is placed into the housing 12 surrounding the biasing member 22. The first water management dam 26 is applied in a liquid form, then expands and sets to form a compressible solid. Preferably, the first water management dam 26 is formed from a closed cell foam. When viewing the housing 12 in cross section lengthwise (see FIG. 1) and widthwise (see FIG. 3), the water management dam 26 fills the cylindrical space 90 inside of the spring coils of the biasing member 22, the space 92 between the spring coils of the first biasing member 22 and the gap 94 between the biasing member 22 and the housing 12. The first water management dam 26 abuts the raised wall 40 of the case portion 34 of the housing 12.

A second water management dam 28 is configured within the housing 12 in a similar manner as the first water management dam 26, but on an opposite side of the arm 14 from the first water management dam 26.

The housing 12 defines first and second sides as previously described. The first side defines a chamber 100 between the first slider 18 and the raised wall 40 of the case portion 34. The second side defines a chamber 102 between the second slider 20 and the raised wall 40 of the case portion. The size of each chamber 100 and 102 shrinks or expands depending upon the movement of the sliders 18 and 20. In the prior art, the chambers 100 and 102 are able to fill with water and freeze. Freezing can cause the housing 12 to break. Freezing can also prevent the biasing members 22 and 24 from being able to compress or expand and as a result prevents movement of the sliders 18 and 20. The first water management dam 26 fills a portion of the first chamber 100. Preferably, the space 90 inside of the first chamber 100 that is also inside of the first biasing member 22 is completely filled by the first water management dam 26. Preferably, the space 92 between the individual spring coils of the first biasing member 22 is filled by the first water management dam 26 between more than half of the coils. Preferably, a gap 94 between the first biasing member 22 and the housing 12 is approximately half filled by the first water management dam.

The second water management dam 28 fills the second chamber 102 of the housing in the same configuration as the first water management dam 26 fills the first chamber 100.

Referring to FIG. 1, as the arm 14 moves, the housing 12 contacts the stopper 50 when the door is past a fully open position. As the door is then moved to a closed position, the housing 12 moves over the arm 14. The sliders 18 and 20 slide on the arm 18 over the peaks 58 and into the notches 56 (compare FIG. 1 to FIG. 4). To reach the top of each peak 58, additional closing force is applied to the door. Likewise, to move the sliders 18 and 20 out of the notches 26, additional closing force is applied to the door. At a closed position, movement of the door is stopped by means that are not part of the door checker 10, such as a door latch. When the door is opened, the housing 12 moves over the arm 14 in an opposite direction.

Figure 4:
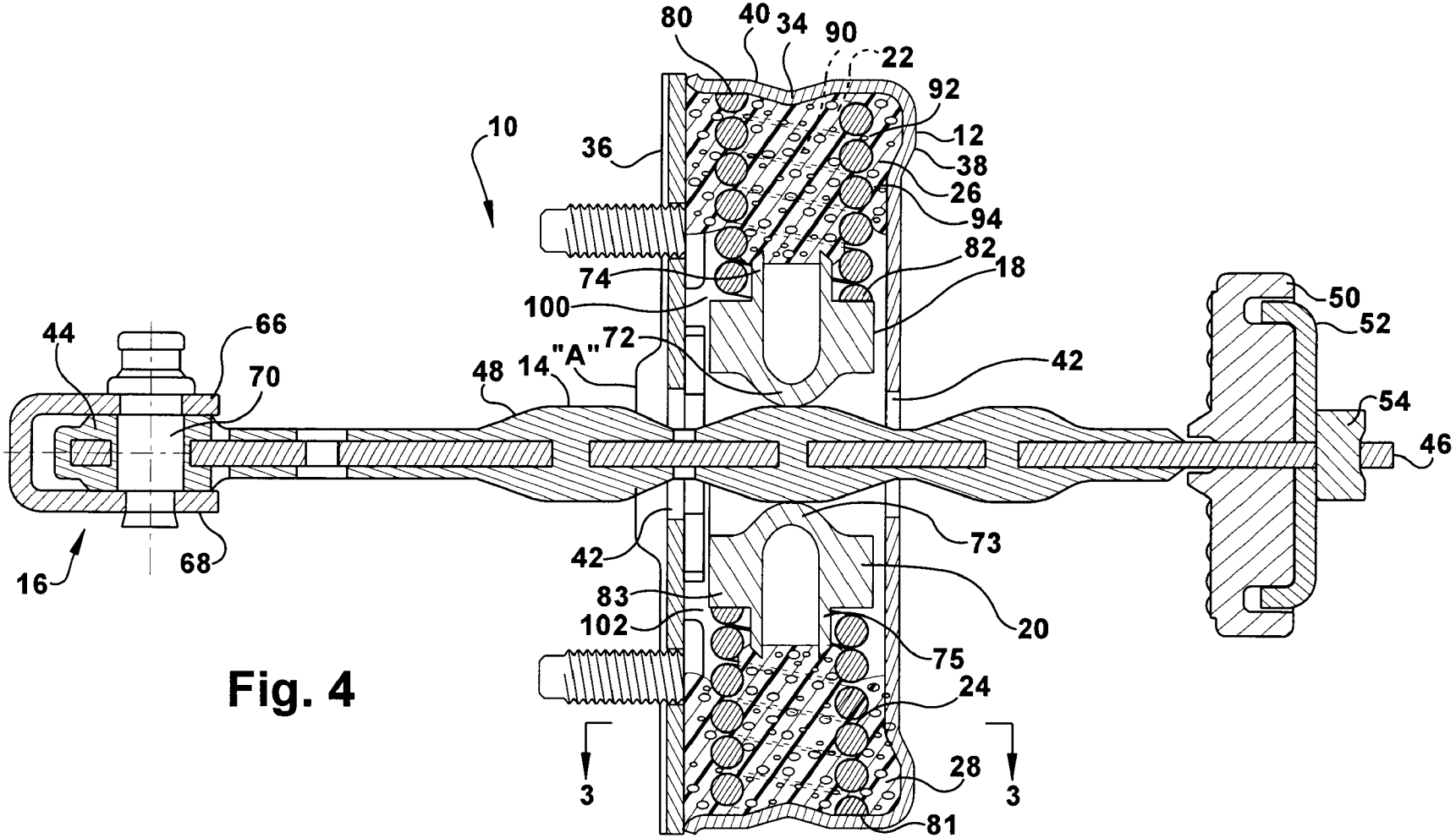
FIG. 4 is a cross-sectional view of the vehicle door checker with the housing in a different position from FIG. 1.

The water management dams prevent the accumulation of water inside the housing 12 by occupying the space where water could otherwise occupy. Additionally, the water management dams 26 and 28 prevent the entry of water into the housing in positions where the water management dams 26 and 28 abut a gap in the housing 12, such as where the case portion 34 meets the cover 36. Referring to FIG. 4, because the water management dams 26 and 28 are preferably foam, when the sliders 18 and 20 move to compress and expand the biasing members 22 and 24, the water management dams 26 and 28 are also able to compress and expand without opening up a gap for the accumulation of water.

The water management dams 26 and 28 may fill any amount of the chambers 100 and 102 in the housing. Additionally, the water management dams 26 and 28 may fill, in different or equal amounts, the space 90 inside of the biasing members 26 and 28, the space 92 between the coils of the biasing members 22 and 24, and the space between the biasing member and the walls of the housing 12.

In a first alternative embodiment of the invention, the door checker includes only a single water management dam 28 located on a lower side of the housing 12.

Figure 5:
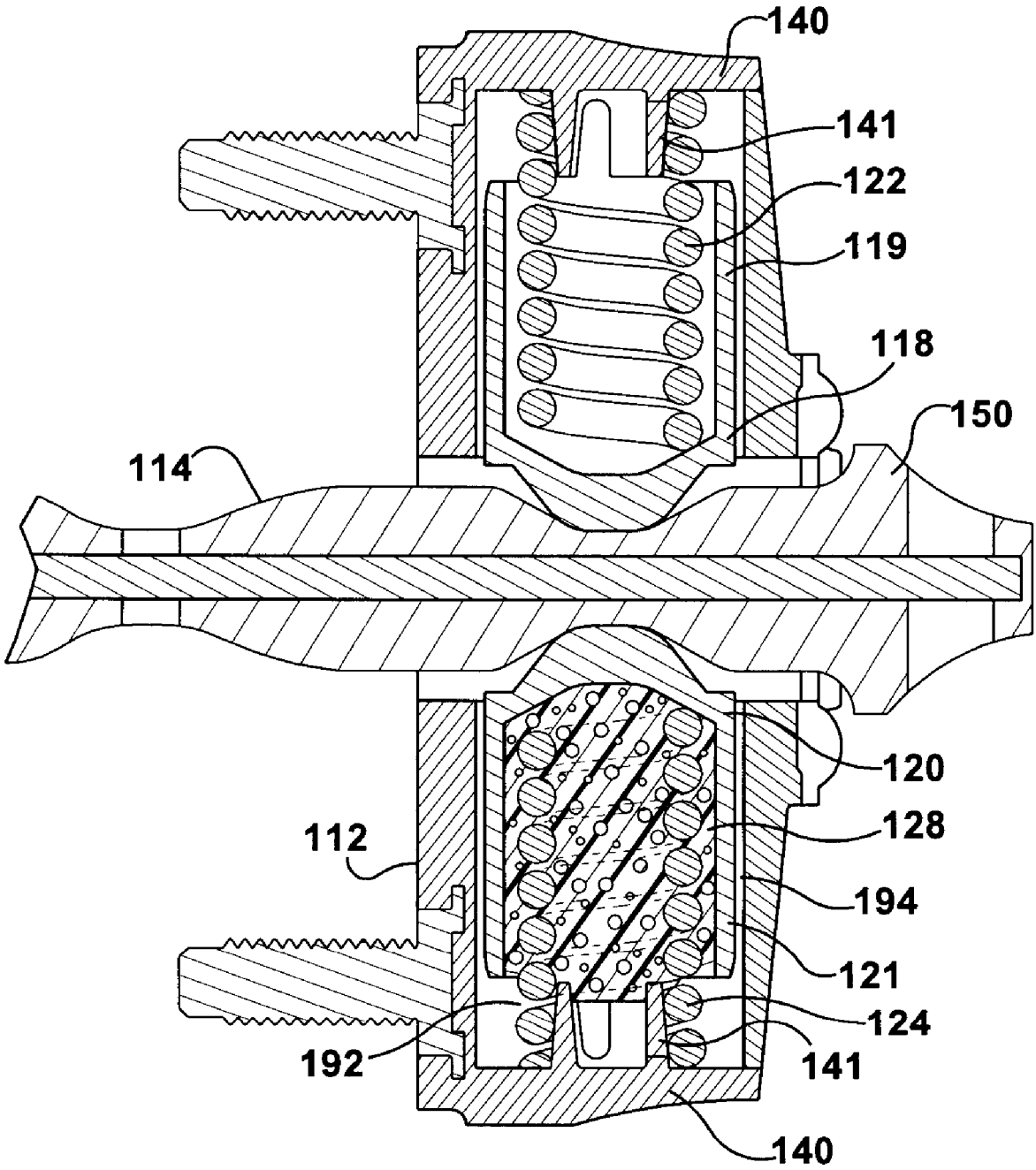
FIG. 5 is a cross-sectional view of an alternate embodiment of a vehicle door checker having a water management dam of the present invention.

Referring to FIG. 5, in a second alternative embodiment of the invention, the sliders 118 and 120 have a different shape as compared to the first embodiment. The sliders 118 and 120 do not include a post on a side opposite the side that contacts the arm 114. Rather, the sliders 118 and 120 include a peripheral wall 119 and 121 that extends from an end of the slider 118 and 120 adjacent to the arm 114 into the space 194 between the biasing member and the housing 112. The peripheral wall 119 and 121 does not extend so far as to interfere with movement of the slider 118 and 120 as the slider 118 and 120 moves along the surface of the arm 114. The raised wall 140 of the housing 112 includes a locator 141 that protrudes into the housing 112 and aids in positioning the biasing member 122 and 124. The water management dam 128 fills the space 190 inside of the biasing member 124, the space 192 between the coils of the biasing member 124, and a part of the space 194 between the biasing member 124 and the housing 112. The slider 118 and 120 also fills a portion of the space 194 between the biasing member 122 and 124 and the housing 112.

A water management dam of the present invention is easy to install within a housing into which the biasing member has already been assembled. Because the water management dam is applied, in one embodiment of the invention, as an expand-into-place foam, fine tolerances do not need to be maintained between the biasing member and housing. Because the water management dams are formed from compressible foam, the movement of the sliders and biasing members is not constrained.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. A vehicle door checker that does not accumulate water, thus avoiding freezing of the water that would prevent operation of the door checker, comprising:

a housing attachable to a vehicle door;

an arm having a first portion attachable to a vehicle, and a second portion that moves through the housing when the vehicle door is moved;

a slider held within the housing, the slider in sliding contact with the second portion of the arm inside of the housing;

a helical spring held within the housing, the helical spring biasing the slider against the second portion of the arm; and a water management dam provided within the housing such that water is prevented from accumulating within the housing, wherein a gap is provided between the spring and the housing holding the spring and wherein the water management dam is comprised of a foam placed on the inside of the spring, between individual coils of the spring and within the gap provided between the spring and the housing.

2. The vehicle door checker of claim 1, wherein the foam is a closed cell foam.

* * * * *